US005380161A

United States Patent [19]

Takenaka et al.

[11] Patent Number: 5,380,161

[45] Date of Patent: Jan. 10, 1995

[54] VARIABLE CAPACITY SWASH-PLATE COMPRESSOR WITH ELECTROMAGNETIC CLUTCH

[75] Inventors: Kenji Takenaka; Hideki Mizutani; Shigeyuki Hidaka; Osamu Hiramatsu; Toru Takeichi; Hiroaki Kayukawa, all of Kariya, Japan

[73] Assignee: Kabushiki Kaisha Toyoda Jidoshokki Seisakusho, Aichi, Japan

[21] Appl. No.: 164,259

[22] Filed: Dec. 9, 1993

[30] Foreign Application Priority Data

| | | | |
|---|---|---|---|
| Dec. 11, 1992 | [JP] | Japan | 4-331606 |
| Dec. 18, 1992 | [JP] | Japan | 4-338558 |
| Dec. 25, 1992 | [JP] | Japan | 4-345881 |
| Jan. 22, 1993 | [JP] | Japan | 4-009204 |

[51] Int. Cl.[6] ..... F04B 49/02

[52] U.S. Cl. ..... 417/222.2; 417/223; 417/269; 417/316

[58] Field of Search ..... 417/222.1, 222.2, 269, 417/270, 316, 317, 420; 192/846

[56] References Cited

U.S. PATENT DOCUMENTS

| | | | |
|---|---|---|---|
| 4,752,189 | 6/1988 | Bearint et al. | 417/270 |
| 4,892,488 | 6/1989 | Terauchi | 417/222.2 |
| 4,940,393 | 7/1990 | Taguchi | 417/222.2 |
| 4,960,366 | 10/1990 | Higuchi | 417/222.2 |
| 5,000,666 | 3/1991 | Esaki | 417/222.2 |
| 5,027,612 | 7/1991 | Terauchi | 417/222.2 |
| 5,039,282 | 8/1991 | Terauchi | 417/222.2 |
| 5,181,831 | 1/1993 | Teraya | 417/222.2 |
| 5,199,541 | 4/1993 | Tobyama et al. | 417/317 |
| 5,286,172 | 2/1994 | Taguchi | 417/270 |

FOREIGN PATENT DOCUMENTS

| | | | |
|---|---|---|---|
| 176675 | 7/1988 | Japan | 417/222.2 |

*Primary Examiner*—Richard E. Gluck
*Assistant Examiner*—Peter Korytnyk
*Attorney, Agent, or Firm*—Burgess, Ryan and Wayne

[57] ABSTRACT

In a swash-plate compressor, pistons are slidably received in cylinder bores. A drive shaft is extended through a crank chamber, and is rotated through an electromagnetic clutch means associated therewith. A conversion mechanism is provided on the shaft for converting a rotational movement of the shaft into a reciprocation of each piston in the corresponding cylinder bore such that a suction stroke and a discharge stroke are alternately executed therein. A fluid is introduced from a suction chamber into the bore during the suction stroke, and during the compression stroke, the fluid is compressed in and discharged from the bore into a discharge chamber. The conversion mechanism is constituted such that a stroke length is shortened in response to an increase of a pressure in the crank chamber, and vice versa. A first passage communicates the crank with the suction chamber, and a second passage communicates the crank chamber with the discharge chamber. A control valve is provided in one of the first or second passage, and is magnetically actuated by the clutch for controlling the pressure in the crank chamber such that the piston stroke can be minimized whenever the clutch is electrically deenergized.

8 Claims, 12 Drawing Sheets

VARIABLE CAPACITY SWASH-PLATE COMPRESSOR WITH ELECTROMAGNETIC CLUTCH

BACKGROUND OF THE INVENTION

1. Field of the Invention

The present invention relates to a swash-plate compressor which is especially incorporated in an airconditioning system used in a vehicle such as an automobile, and more particularly to such a variable capacity swash-plate compressor driven by a prime mover of the vehicle through the intermediary of an electromagnetic clutch.

2. Description of the Related Art

For example, U.S. Pat. No. 3,861,829 and Japanese Unexamined Patent Publication (Kokai) No. 1(1989)-142277 disclose representative types of variable capacity swash-plate compressors, which may be incorporated in an air-conditioning system used in a vehicle such as an automobile. These compressors comprise a cylinder block, a front housing combined with a front side of the cylinder block to define a crank chamber therebetween, a valve plate assembly attached to a rear side of the cylinder block, and a rear housing combined with the a valve plate assembly to define a suction chamber and a discharge chamber therebetween. The cylinder block has a plurality of cylinder bores formed radially and circumferentially therein and spaced from each other at regular intervals, and each of the cylinder bores slidably receives a piston. The valve plate assembly is provided with sets of suction reed valves and discharge reed valves, and each set of suction and discharge reed valves is disposed to be encompassed within an end opening area of the corresponding cylinder bore which can be communicated with the respective suction and discharge chambers through the set of suction and discharge reed valves. The suction chamber and the discharge chamber are in communication with an evaporator and a condenser of the air-conditioning system, respectively, so that a fluid or refrigerant is supplied from the evaporator to the suction chamber and a compressed refrigerant is delivered from the discharge chamber to the condenser.

The compressor also comprises a drive shaft extended through the crank chamber and rotationally driven by the prime mover of the vehicle through the intermediary of an electromagnetic clutch provided on the front housing, and a conversion mechanism provided on the shaft for converting a rotational movement of the shaft into a reciprocation of each piston in the corresponding cylinder bore such that a suction stroke and a compression stroke are alternately executed therein. During the suction stroke, the refrigerant is introduced from the suction chamber into each of the cylinder bores through the corresponding suction reed valve, and, during the compression stroke, the refrigerant is compressed and discharged from each of the cylinder bores into the discharge chamber through the corresponding discharge reed valve.

The conversion mechanism includes a drive member mounted on the shaft so as to be rotated together therewith, and an annular cam plate member pivotably connected to the drive member, with the shaft extending through a central opening of the annular cam plate member which is supported by the shaft so as to be movable in an axial direction of the shaft and swingable about a lateral axis perpendicularly intersecting with the axis of the shaft. The conversion mechanism also includes a swash-plate member slidably mounted on the cam plate member such that the swash-plate member cannot be rotated together with the cam plate member, and thus during the rotation of the cam plate member, the swash-plate member is only swung about the above-mentioned lateral axis. The conversion mechanism further includes a plurality of connecting rods to establish an operational connection between the swash-plate member and the pistons so as to cause the reciprocation of each piston in the corresponding cylinder bore. Namely, the rotational movement of the shaft is converted into the reciprocation of the pistons through the drive member, can plate member, swash-plate member, and connecting rods.

A length of the stroke executed by each piston depends upon an angle of inclination which a plane of the cam plate member defines with the axis of the shaft, and the angle of inclination is governed by a pressure in the crank chamber which is in communication with the suction chamber and/or the discharge chamber under control. Thus, the displacement or capacity of the compressor varies by a change of the pressure in the crank chamber. In general, as the pressure in the crank chamber becomes larger, the angle of inclination of the cam plate member is varied to shorten the stroke length of the piston so that the capacity of the compressor is reduced. Namely, as the pressure in the crank chamber becomes larger, the angle of inclination of the cam plate member gradually approaches to zero. Note, when the angle of inclination of the cam plate member is zero, the plane thereof defines 90 degrees with the axis of the shaft. Reversely, as the pressure in the crank chamber becomes smaller, the angle of inclination of the cam plate member is varied to lengthen the stroke length of the piston so that the capacity of the compressor is increased. Namely, as the pressure in the crank chamber becomes smaller, the cam plate member is more greatly inclined with respect to the axis of the shaft.

The compressor is frequently stopped while it is run at large or full capacity, i.e., the cam plate member is greatly or maximumly inclined with the axis of the shaft. This great or maximum inclination of the cam plate member is kept until a running of the compressor is again started. Accordingly, in the beginning of the running of the compressor, the compressor is subjected to an initial large load because the piston must be suddenly moved through a large or maximum stroke. Of course, when the compressor overcomes the sudden initial large load, not only the movable parts of the compressor inclusive of the electromagnetic clutch are susceptible to damage, but also a driver of the automobile may feel an uncomfortable movement of the vehicle.

Japanese Unexamined Utility Model Publication (JU-UMP) (Kokai) No. 64(1989)-15776 discloses a variable capacity swash-plate compressor as mentioned above, which is constituted such that the cam plate member is moved so that the angle of inclination thereof approaches zero, whenever the compressor is stopped. In particular, the compressor is provided with a control valve incorporated therein for controlling the communication between the crank chamber and the suction and discharge chambers, and this control valve is operated in two modes. In one mode of operation, during the running of the compressor, the control valve is used to regulate the angle of inclination of the cam plate member in accordance with a variation of a cooling load to be borne by the air-conditioning system. In the other mode of operation, when the compressor is stopped, the control valve is used to communicate the crank chamber with the discharge chamber over a given time of period, while cutting the communication between the crank chamber and the suction chamber. Accordingly, whenever the compressor is stopped, the cam plate member is moved so that the angle of inclination thereof approaches to zero. Thus, when the compressor is again run, it is not subjected to a large load in the beginning of the running thereof.

Nevertheless, the compressor as disclosed in JUUMP No. 64(1989)-15776 is very expensive because it must be provided with an actuator such as a solenoid for actuating the control valve, and an electronic control circuit for controlling the actuator.

SUMMARY OF THE INVENTION

Therefore, an object of the present invention is to provide a swash-plate compressor as mentioned above, which can be constituted at low cost such that the cam plate member is moved so that the angle of inclination thereof approaches to zero, whenever the compressor is stopped.

In accordance with the present invention, there is provided a swash-plate compressor comprising: a cylinder block having a plurality of cylinder bores; a plurality of pistons slidably received in the respective cylinder bores; a first housing combined with the cylinder block to define a crank chamber; a second housing combined with the cylinder block to define a suction chamber and a discharge chamber; a drive shaft extended through the crank chamber; an electromagnetic clutch means associated with the drive shaft for selectively transmitting a rotational drive force from a drive source to the drive shaft; and a conversion means for converting a rotational movement of the drive shaft into a reciprocation of each piston in the corresponding cylinder bore such that a suction stroke and a discharge stroke are alternately executed therein. A fluid is introduced into the cylinder bore during the suction stroke, and during the compression stroke, and the introduced fluid is compressed in and discharged from the cylinder bore into the discharge chamber. The conversion means is constituted such that the stroke length is shortened in response to an increase in the pressure in the crank chamber, and vice versa. The compressor further comprises: a first passage means for communicating the crank chamber with the suction chamber; and a second passage means for communicating the crank chamber with the discharge chamber; and a control valve means provided in the first passage means. The control valve means is magnetically actuated by electrical energization of the electromagnetic clutch means to open the first passage means. Also, the control valve means is magnetically actuated by electrical deenergization of the electromagnetic clutch means to close the first passage means, so that the pressure in the crank chamber is increased by establishment of communication between the crank chamber and the discharge chamber due to the existence of the second passage means.

Alternatively, the control valve means may be provided in the second passage means, and the control valve means is magnetically actuated by electrical energization of the electromagnetic clutch means to close the second passage means. Also, the control valve means is magnetically actuated by electrical deenergization of the electromagnetic clutch means to open the second passage means, so that the pressure in the crank chamber is increased by establishment of communication between the crank chamber and the discharge chamber.

In the present invention, the compressor may comprise a regulating valve means provided in the first passage means for regulating the pressure in the crank chamber in accordance with a change of the pressure in the suction chamber. Also, the drive shaft may be formed of a magnetic material so that it exhibits a magnetic property, and the control valve means may be incorporated in the cylinder block in the vicinity of one end of the drive shaft for the magnetic actuation thereof. Further, the control valve means may be incorporated in the electromagnetic clutch means for the magnetic actuation thereof.

BRIEF DESCRIPTION OF THE DRAWINGS

The other objects and advantages of the present invention will be better understood from the following description, with reference to the accompanying drawings, in which.

DESCRIPTION OF THE PREFERRED EMBODIMENTS

Figure 1:
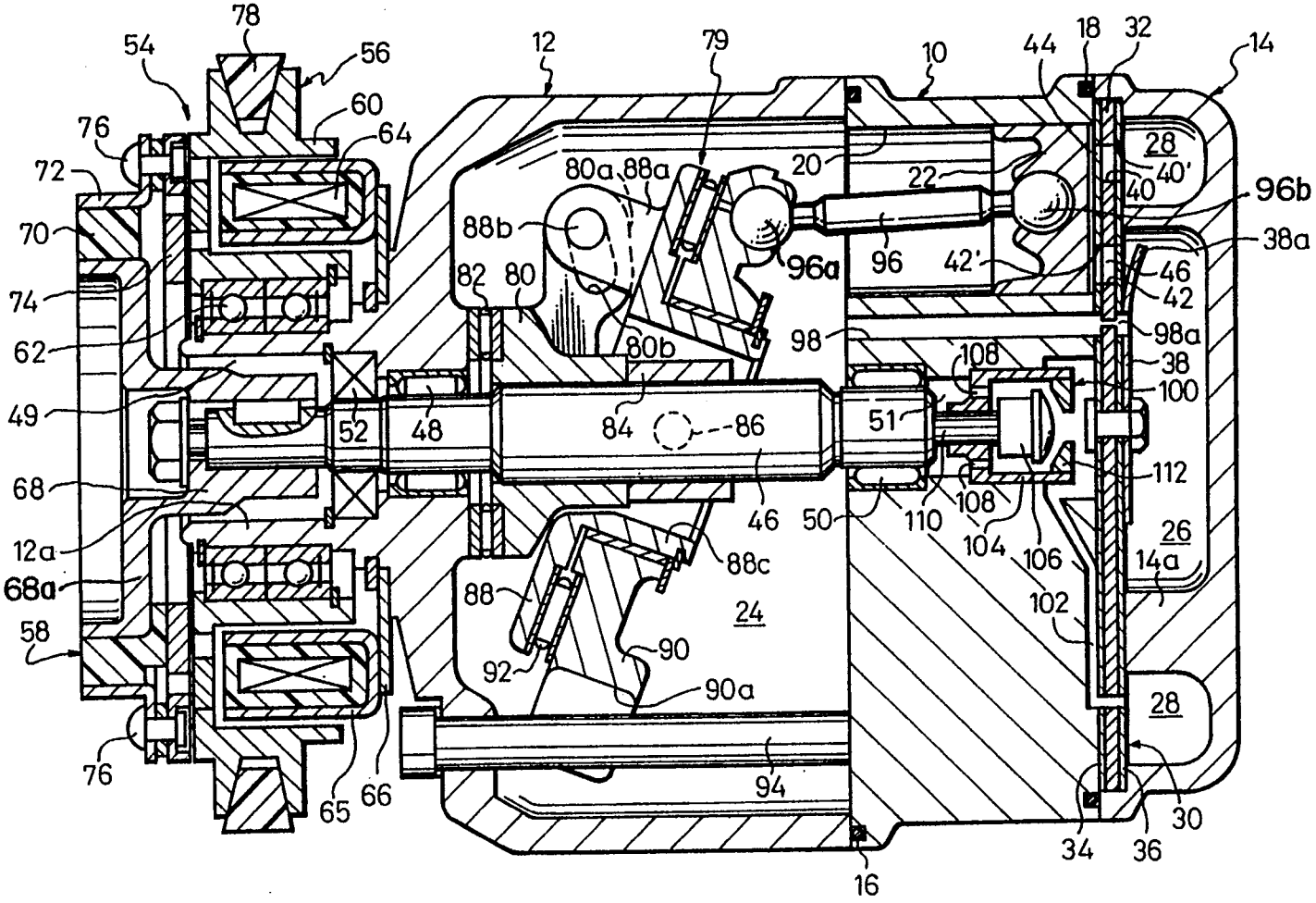
FIG. 1 is a longitudinal sectional view showing a first embodiment of a variable capacity swash-plate type compressor according to the present invention.
Figure 2:
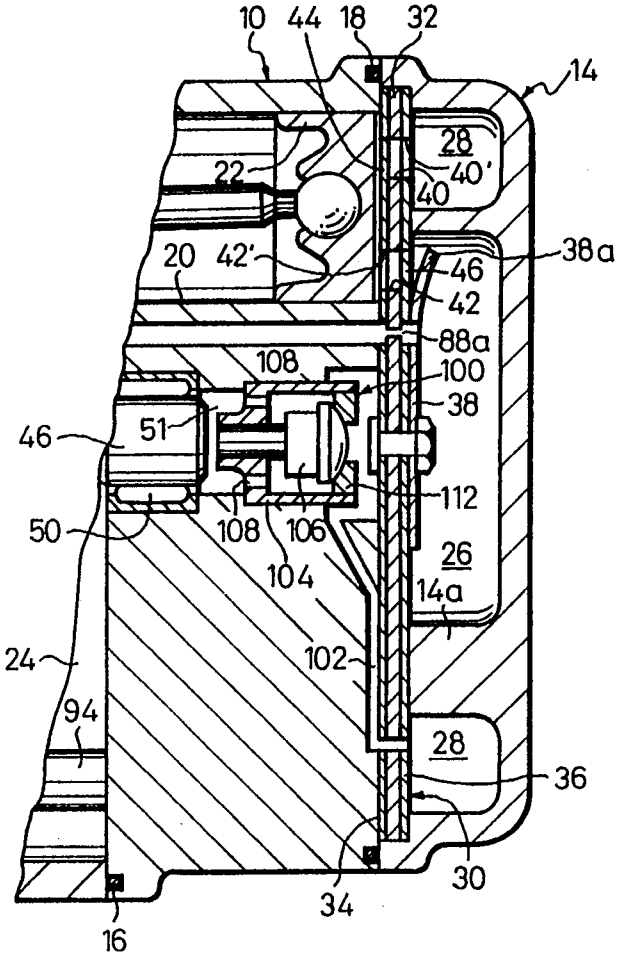
FIG. 2 is a partial view of FIG. 1, but showing a control valve body at a different position.

FIGS. 1 and 2 show a first embodiment of a swash-plate compressor according to the present invention, which may be used in an air-conditioning system (not shown) for a vehicle such as an automobile. The compressor comprises a cylinder block 10, front and rear housings 12 and 14 securely and hermetically joined to the cylinder block 10 at front and rear end faces thereof through the intermediary of O-ring rings 16 and 18, respectively. The cylinder block 10 and the housings 12 and 14 are assembled as an integrated unit by screws (not visible). The cylinder block 10 has a plurality of cylinder bores 20 formed radially and circumferentially therein and spaced from each other at regular intervals, and each of the cylinder bores 20 slidably receives a piston 22. The number of cylinder bores 20 is not decisive for the invention and it may be six. Note, in FIG. 1, only one of the cylinder bores 20 is visible. The front housing 12 has a crank chamber 24 defined therewithin, and the rear housing 14 has a central discharge chamber 26 and an annular suction chamber 28 defined therewithin and partitioned by an annular wall portion 14*a* integrally projected from an inner wall of the rear housing 14. When the compressor is incorporated in the air-conditioning system, the discharge chamber 26 and the suction chamber 28 are in communication with a condenser and an evaporator of the air-conditioning system, respectively, so that a fluid or refrigerant is supplied from the evaporator to the suction chamber 28 and a compressed refrigerant is delivered from the discharge chamber 26 to the condenser.

A valve plate assembly 30 is disposed between the rear end face of the cylinder block 10 and the rear housing 14, and defines six compression chambers together with the heads of the pistons 22 slidably received in the cylinder bores 20. The valve plate assembly 30 includes a disc-like plate member 32, a suction reed valve sheet 34 applied to an inner side surface of the disc-like plate member 32, a discharge reed valve sheet 36 applied to an outer side surface of the disc-like plate member 32, and a retainer plate member 38 applied to an outer side surface of the discharge reed valve sheet 36.

The disc-like member 32 may be made of a suitable metal material such as steel, and has six sets of suction and discharge ports 40 and 42 formed radially and circumferentially therein and spaced from each other at regular intervals, so that each set of the suction and the discharge ports 40 and 42 is encompassed within an end opening area of the corresponding one of the cylinder bores 20. The suction reed valve sheet 34 and the discharge reed valve sheet 36 may be made of spring steel, phosphor bronze, or the like. The suction reed valve sheet 34 has six suction reed valve elements 44 formed integrally therewith and arranged radially and circumferentially to be in register with the suction ports 40, respectively, whereby each of the suction reed valve elements 44 can be moved so as to open and close the corresponding suction port 40, due to a resilient property thereof. The suction reed valve sheet 34 further has six discharge openings 42′ formed therein and arranged radially and circumferentially to be in register with the suction discharge port 42, repsectively. Also, the discharge reed valve sheet 36 has six discharge reed valve elements 46 formed integrally therewith and arranged radially and circumferentially to be in register with the discharge ports 42, respectively, whereby each of the discharge reed valve elements 46 can be moved so as to open and close the corresponding suction port 42, due to a resilient property thereof. The discharge reed valve sheet 36 further has six suction openings 40′ formed therein and arranged radially and circumferentially to be in register with the suction ports 40, respectively.

The retainer member 38 may be made of a suitable metal material such as steel, and is preferably coated with a very thin rubber layer. The retainer member 38 has six retainer elements 38*a* radially extended therefrom and arranged radially and circumferentially to be in alignment with the discharge reed valve elements 46, respectively. As shown in FIG. 1, each of the retainer elements 38*a* provides a sloped bearing surface for the corresponding one of the discharge reed valve elements 46, so that each discharge reed valve element 42 is opened only by a given angle defined by the sloped bearing surface.

A drive shaft 46 extends within the front housing 12 so that a rotational axis thereof matches a longitudinal axis of the front housing 12, and is rotatably supported by a first radial bearing 48 provided in a central bore 49 formed in a neck portion 12*a* of the front housing 12 and by a second radial bearing 50 provided in a central bore 51 formed in the cylinder block 10. Note, in this embodiment, the shaft 46 is formed of a magnetic material such as steel for the reasons mentioned hereinafter. A rotary seal unit 52 is provided in the central passage of the neck portion 12*a* to seal the crank chamber 24 from the outside.

A front end of the drive shaft 46 is placed at the central bore 49 of the neck portion 12*a*, and is operatively connected to a prime mover of the vehicle through the intermediary of an electromagnetic clutch 54 for rotation of the drive shaft 46. The electromagnetic clutch 54 comprises two parts; an electromagnetic assembly 56 and an armature assembly 58 associated therewith. The electromagnetic assembly 56 includes an annular rotor member 60 rotatably mounted on the neck portion 12*a* through the intermediary of a radial bearing 62, and a stationary electromagnet 64 combined with the annular rotor member 60. The electromagnet 64 is held by an annular frame member 65 incorporated in the rotor member 60, and the frame member 65 is supported by an annular support plate 66 securely attached to the housing 12. The armature assembly 58 includes a hub member 68 securely joined to the front end of the drive shaft 46, a resilient annular member 70 formed of a suitable rubber material and securely attached on a radially extended portion 68*a* of the hub member 68, a sleeve member 72 securely mounted on the resilient annular member 70, and an annular plate-like armature member 74 fixed to the sleeve member 72 by rivets 76.

As is apparent from FIG. 1, the annular rotor member 60 has a V-shaped cross sectional groove formed therearound so as to receive a V-belt 78, and is subjected to a rotational drive force from the prime mover of the vehicle through the intermediary of the V-belt 78. Usually, the armature member 74 is merely disposed to be close to an end face of the annular rotor member 60, as shown in FIG. 1. However, when the electromagnet 64 is electrically energized, the armature member 74 is magnetically attracted to and engaged with the end face of the annular rotor member 60, so that the assemblies 56 and 58 are coupled to each other as a unit. Namely, only when the electromagnet 64 is electrically energized, the drive shaft 46 is being rotated by the prime mover of the vehicle.

A conversion mechanism 79 is provided on the shaft 46 within crank chamber 24 for converting a rotational movement of the shaft 46 into a reciprocation of the pistons 22. The conversion mechanism 79 includes a drive member 80 securely mounted on the shaft 46 so as to be rotated together therewith, with a thrust bearing 82 being disposed between the drive member 54 and an inner face of an end wall of the front housing 12. The conversion mechanism 79 also includes a sleeve member 84 slidably mounted on the shaft 46 and having a pair of pin elements 86 projected diametrically therefrom (Note, in FIG. 1, only one of the pin elements 86 is illustrated by a broken line), and a cam plate member 88 swingably supported by the pair of pin elements 86. As apparent from FIG. 1, the cam plate member 88 is in an annular form, and the shaft 46 extends through a central opening of the cam plate member 88. The drive member 80 is provided with an extension 80*a* having an elongated guide slot 80*b* formed therein, and the cam plate member 88 is provided with a bracket portion 88*a* projected integrally therefrom and having a guide pin element 88*b* received in the guide slot 80*b*, whereby the cam plate member 88 can be rotated together with the drive member 80, and is swingable or rotatable about a lateral axis defined by the pair of pin elements 86.

The conversion mechanism further includes a swash-plate member 90 slidably mounted on an annular portion 88*c* which is projected integrally from the cam plate member 88, with a thrust bearing 92 being disposed between the cam plate member 88 and the swash-plate member 90. As shown in FIG. 1, the swash-plate member 90 has a slot 90*a* formed at a periphery thereof, and the slot 90*a* slidably receives a guide rod 94 extended through the housing 12 and supported by the end wall thereof and the cylinder block 10. Accordingly, during the rotation of the cam plate member 88, the swash-plate member 90 cannot be rotated, but it can be swung about an axis defined by the pair of pin elements 86. Furthermore, the conversion mechanism 79 includes six connecting rods 96, through which the swash-plate member 90 is operatively connected to the pistons 22. In particular, each of the connecting rods 96 has spherical ends 96*a* and 96*b* which are slidably received in spherical recesses formed in the swash-plate member 90 and the corresponding piston 22, respectively.

With the arrangement of the conversion mechanism 79 as mentioned above, the respective pistons 22 can be reciprocated in the cylinder bores 20 due to the rotational movement of the shaft 46.

The crank chamber 24 is in communication with the discharge chamber 26 through a passage 98 formed in the cylinder block 10 and the valve plate assembly 30, and the passage 98 is restricted at a location indicated by reference 98*a*. On the other hand, the crank chamber 24 can be communicated with the suction chamber 28 through a control valve assembly 100 provided in the central bore 51 of the cylinder block 10, and through a passage 102 formed in the cylinder block 10 and the valve plate assembly 30 to extend between the suction chamber 28 and the central bore 51. The valve assembly 100 includes a cylindrical valve casing 104 securely and hermetically disposed in the central bore 51, and a valve body 106 received in the valve casing 104. An end side of the valve casing 104 is closed by an end wall integrally formed therewith, but the end wall has some through holes 108 formed therein, so that an interior of the valve casing 104 is in communication with the crank chamber 24. Also, the end wall of the valve casing 104 has a central hole formed therein, in which a stem 110 extended from the valve body 106 is slidably and hermetically received. The valve body 106 is movable between an open position, as shown in FIG. 1, in which the valve body 106 is apart from the valve seat 112 and a closed position, as shown in FIG. 2, in which the valve body 106 is seated on the valve seat 112. When the stem 110 is constructed as an integral portion of the valve body 106, both the elements 106 and 110 are formed of a magnetic material such as steel. However, this is not decisive for the embodiment as shown in FIG. 1. For example, when each of the valve body 106 and the stem 110 is constructed as an individual part, the valve body 106 may be formed of a non-magnetic material such as a plastic material, but the stem 110 must be formed of the magnetic material.

In operation, when the electromagnetic clutch 54 is engaged by electrically energizing the electromagnet 64, the shaft 46 is rotationally driven together with the drive member 80. Simultaneously, the drive shaft 46 exhibits a magnetic property due to a magnetic field produced by the electrical energization of the electromagnet 64, so that the valve body 108 with the stem 110 is magnetically attracted to the end face of the shaft 46, whereby the valve body is placed at the open position as shown in FIG. 1 so as to establish the communication between the crank chamber 24 and the suction chamber 28.

As mentioned above, the rotational movement of the shaft 46 is converted into the reciprocation of the pistons 22 by the conversion mechanism 79, so that a suction stroke and a compression stroke are alternately executed in each of the cylinder bores 20. During the suction stroke, the refrigerant is introduced from the suction chamber 28 into each of the cylinder bores 20 through the corresponding suction reed valve element 44. On the other hand, during the compression stroke, the introduced refrigerant is compressed in each of the cylinder bores 20, and is then discharged therefrom into the discharge chamber 26 through the corresponding reed valve 46.

Accordingly, the pressure in the discharge chamber is gradually increased, so that a small part of the discharged refrigerant is introduced from the discharge chamber 26 into the crank chamber 24 through the restricted passage 98. Nevertheless, a pressure in the crank chamber 24 cannot be considerably increased due to the communication established between the crank chamber 24 and the suction chamber 28. Namely, the pressure in the crank chamber 24 is kept to be substantially equal to that in the suction chamber 28. Thus, the cam plate member 88 is rotated about the lateral axis defined by the pin elements 68, in the clockwise direction in FIG. 1, i.e., the cam plate member 88 is inclined with the rotational axis of the shaft 46, so that the displacement or capacity of the compressor is gradually increased.

When the compressor is stopped, i.e., when the rotational movement of the shaft 46 is stopped by electrically deenergizing the electromagnetic clutch 54, the shaft 46 exhibit no magnetic property so that the valve body 106 is moved toward the closed position as shown in FIG. 2, due to a force produced by a stream of refrigerant flowing from the crank chamber 24 into the suction chamber 28. When the valve body 106 is placed at the closed position, the communication is cut between the crank chamber 24 and the suction chamber 28, so that the pressure in the crank chamber 24 is immediately increased due to introduction of the pressurized refrigerant from the discharge chamber 26 thereinto. Accordingly, the cam plate member 88 is rotated about the lateral axis defined by the pin elements 86, in the counterclockwise direction in FIG. 1. Namely, the cam plate member 88 is moved so that a plane thereof defines an angle of 90 degrees with respect to the rotational axis of shaft 46. Thus, when the compressor is again run, it cannot be subjected to a large load at the beginning of the running thereof.

Figure 3:
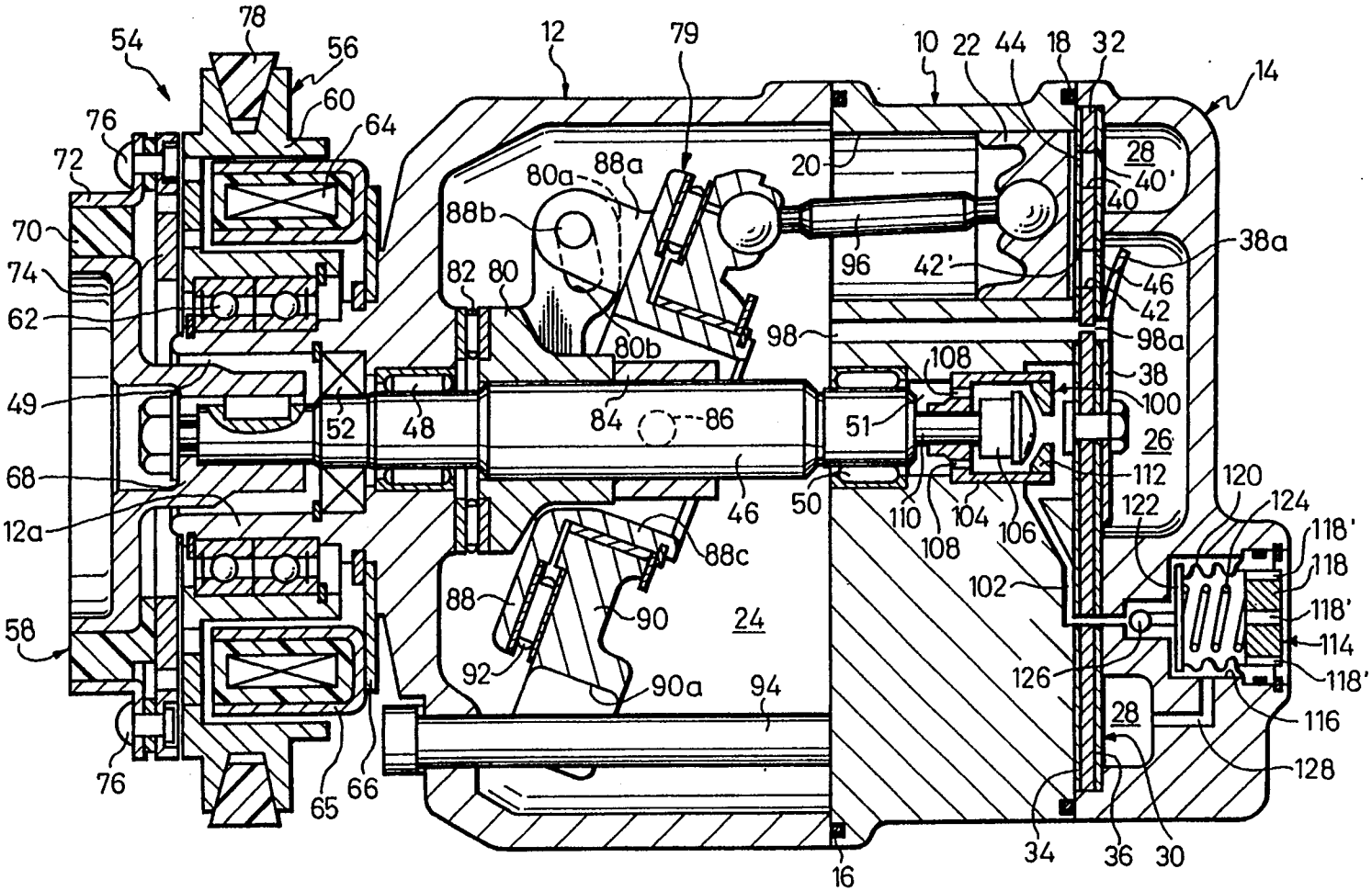
FIG. 3 is a longitudinal sectional view showing a modification of the first embodiment of FIG. 1.

FIG. 3 shows a modification of the embodiment shown in FIGS. 1 and 2. The elements or features similar to those of FIGS. 1 and 2 are indicated by the same references. In this modified embodiment, the passage 102 is in communication with the suction chamber 28 through a valve assembly 114 provided in a bore 116 formed in the rear housing 14, and the valve assembly 114 regulates the pressure in the crank chamber 24, so that the displacement or capacity of the compressor is controlled in accordance with a variation in cooling load borne by the air-conditioning system. In particular, the regulating valve assembly 114 includes a circular end plate 118, a bellows 120 securely attached to and extended from the end plate plate 118, a free end plate 122 fixed to a free end face of the bellows 120, a compressed coil spring 124 provided between the end plates 118 and 122 in the bellows 120, and a spherical valve body 126 supported by the free end plate 122. The valve assembly 114 is received in the bore 116 such that the end plate 118 is securely mounted on an inner wall of the bore 116 to close an opening thereof, and such that the spherical valve body 126 is disposed in the vicinity of an end port at which the passage 102 is opened to the bore 116. An interior of the bellows 120 is in communication with outside through ports 118' formed in the end plate 118, and the exterior of the bellow 120, and therefore the bore 116, is in communication with the suction chamber 28 through a passage 128 formed in the rear housing 14.

While the compressor is run, i.e., while the valve body 106 is magnetically attracted to the end face of the shaft 46 to be thereby placed at the open position, the communication is continously maintained between the crank chamber 24 and the suction chamber 28, but a flow rate of refrigerant introduced from the crank chamber 24 into the suction chamber 28 is adjustably restricted by the spherical valve body 126 in accordance with a variation of a pressure in the suction chamber 28. In particular, as the cooling load to be borne by the air-conditioning system becomes larger, the pressure in the suction chamber 28 is increased so that the bellows 120 is compressed against the resilient force of the spring 124. Accordingly, the spherical valve body 126 is moved away from the end port of the passage 102 so as to increase the flow rate of refrigerant introduced from the crank chamber 24 into the suction chamber 28. Thus, the pressure in the crank chamber 24 approaches that of the suction chamber 28, so that the cam plate member 88 is more greatly inclined with respect to the rotational axis of the shaft 46, whereby the displacement or capacity of the compressor is increased. On the contrary, as the cooling load to be born by the air-conditioning system becomes smaller, the pressure in the suction chamber 28 is reduced so that the bellows 120 is expanded due to the resilient force of the spring 124. Accordingly, the spherical valve body 126 is more closed to the end port of the passage 102 so as to reduce the flow rate of refrigerant introduced from the crank chamber 24 into the suction chamber 28. Thus, the pressure in the crank chamber 24 becomes relatively higher than that of the suction chamber 28, so that a degree of inclination of the cam plate member 88 becomes smaller, whereby the displacement or capacity of the compressor is reduced.

Of course, in the modified embodiment as shown in FIG. 3, when the compressor is stopped, i.e., when the rotational movement of the shaft 46 is stopped by electrically deenerging the electromagnetic clutch 54, the shaft 46 exhibits no magnetic property so that the valve body 106 is moved from the open position (FIG. 1) to the closed position (FIG. 2), so that the communication is cut between the crank chamber 24 and the suction chamber 28. Accordingly, similar to the embodiment of FIGS. 1 and 2, the cam plate member 88 is rotated about the lateral axis defined by the pin elements 86, in the counterclockwise direction in FIG. 3, and thus, when the compressor is again run, it is not subjected to a large load at the beginning of the running thereof.

Figure 4:
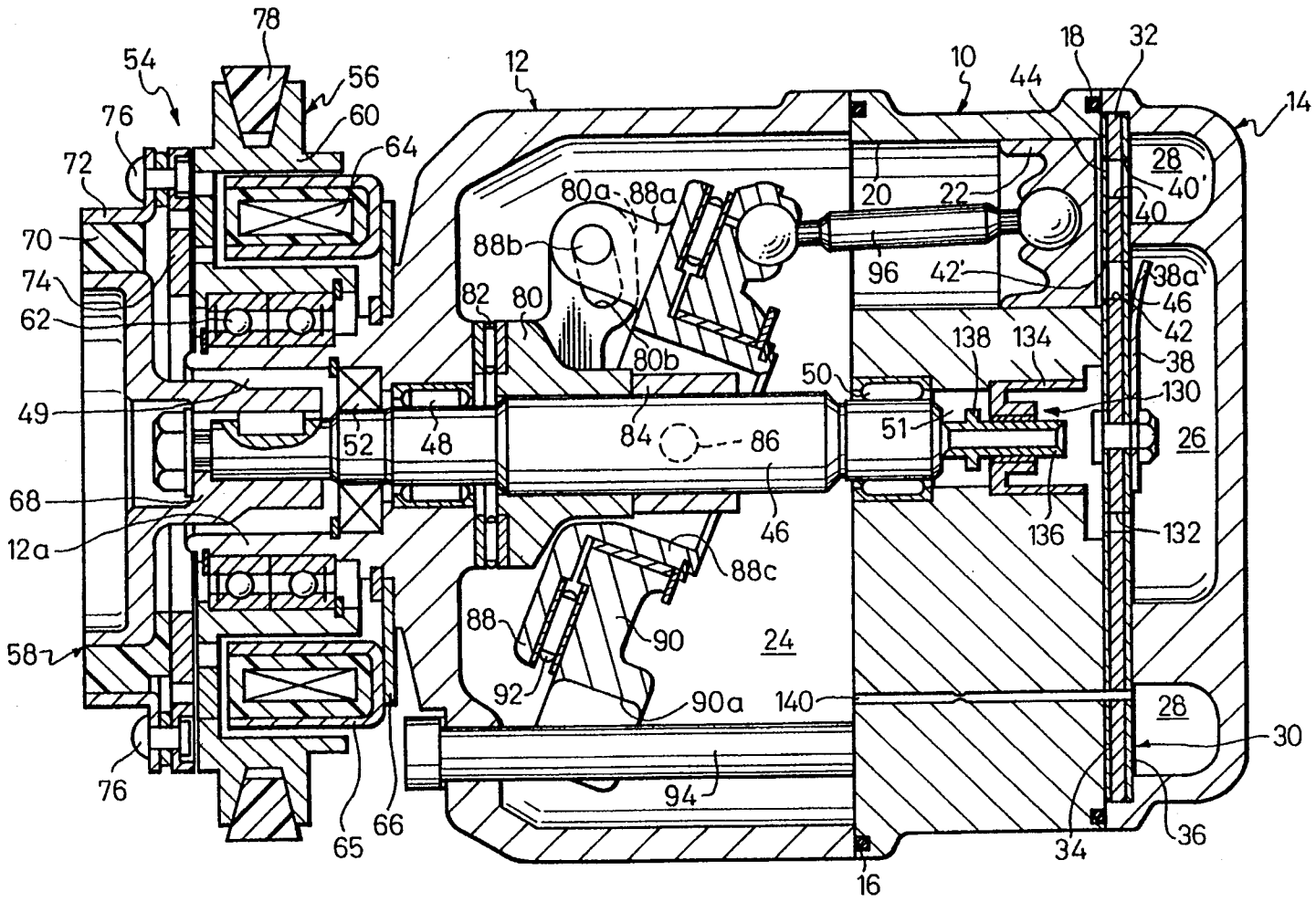
FIG. 4 is a longitudinal sectional view showing a second embodiment of a variable capacity swash-plate type compressor according to the present invention.
Figure 5:
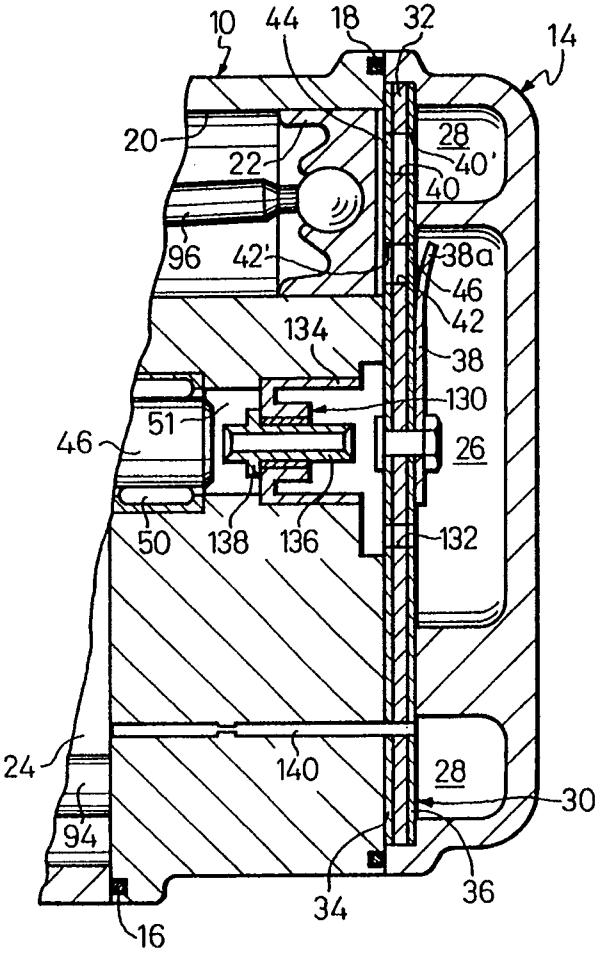
FIG. 5 is a partial view of FIG. 4, but showing a control valve body at a different position.

FIGS. 4 and 5 show a second embodiment of a variable capacity swash-plate compressor according to the present invention. Note, in FIGS. 4 and 5, the elements or features similar to those of the FIGS. 1 and 2 are indicated by the same references.

In the second embodiment, the crank chamber 24 can communicate with the discharge chamber 26 through a control valve assembly 130 provided in the central bore 51 of the cylinder block 10, and through a hole 132 formed in the valve plate assembly 30. The valve assembly 130 includes a cylindrical valve casing 134 securely and hermetically disposed in the central bore 51, and a tubular valve body 136 slidably and hermetically received in a hole formed in an end wall of the valve casing 134. As is apparent from FIG. 4 and 5, the central bore 52 is divided by the end wall of the valve casing 34 into a front chamber section and a rear chamber section. The tubular valve body 136 is formed from a magnetic material such as steel, and has a flange 138 integrally projected therearound to limit the sliding movement of the valve body 136 in the hole formed in the end wall of the valve casing 134. The tubular valve body 136 is movable between a closed position, as shown in FIG. 4, in which a front end of the tubular valve body 136 is abutted against the end face of the shaft 46 and an open position, as shown in FIG. 5, in which the tubular valve body 136 is apart from the end face of the shaft 46. Also, the crank chamber 24 is in communication with a restricted passage 140 formed in the rear housing 14.

Similar to the first embodiment of FIGS. 1 and 2, when the electromagnetic clutch 54 is shoved in by electrically energizing the electromagnet 64, the shaft 46 is rotationally driven, and exhibits a magnetic property due to a magnetic field produced by the electrical energization of the electromagnet 64. Accordingly, the tubular valve body 136 is magnetically attracted to the end face of the shaft 46 to be thereby placed at the closed position (FIG. 4), so that the communication is cut between the crank chamber 24 and the discharge chamber 26. Although the crank chamber 24 and the discharge chamber 26 cannot be communicated with each other during the running of the compressor, the pressure in the crank chamber 24 has a tendency toward being increased, because, during the compression stroke of each piston 22, a small part of the refrigerant compressed by the piston 22 escapes into the crank chamber 24 through clearances between an inner peripheral wall surface and an outer peripheral wall surface of the piston 22. Nevertheless, the increase of pressure in the crank chamber 24 is suppressed because the crank chamber 24 is in communication with the suction chamber 28 through the restricted passage 140. Namely, the pressure in the crank chamber is kept to be substantially equal to that in the suction chamber 28. Accordingly, the cam plate member 88 is gradually inclined with the rotational axis of the shaft 46, so that a displacement or capacity of the compressor is gradually increased.

When the rotational movement of the shaft 46 is stopped by electrically deenerging the electromagnetic clutch 54, the shaft 46 exhibit no magnetic property so that the tubular valve body 136 is moved toward the open position as shown in FIG. 5, due to a force produced by a stream of pressurized refrigerant flowing from the rear chamber section of the central bore 51 into the front chamber section thereof through a central hollow passage of the tubular valve body 136. Accordingly, the pressure in the crank chamber 24 is immediately increased due to introduction of the pressurized refrigerant from the discharge chamber 26 thereinto, so that the cam plate member 88 is rotated about the lateral axis defined by the pin elements 86, in the counterclockwise direction in FIG. 4. Namely, the cam plate member 88 is moved so that the plane thereof defines an angle of 90 degrees with respect to the rotational axis of shaft 46. Thus, when the compressor is again run, it is not subjected to a large load at the beginning of the running thereof.

Note, in the second embodiment of FIGS. 4 and 5, when the pressurized refrigerant is introduced from the discharge chamber 26 into the crank chamber 24, a small part of the pressurized refrigerant escapes from the crank chamber 24 into the suction chamber 28 through the passage 140. Nevertheless, the immediate increase of pressure in the crank chamber is hardly affected by the escape of refrigerant, because the passage 140 is restricted as shown in FIGS. 4 and 5.

Figure 6:
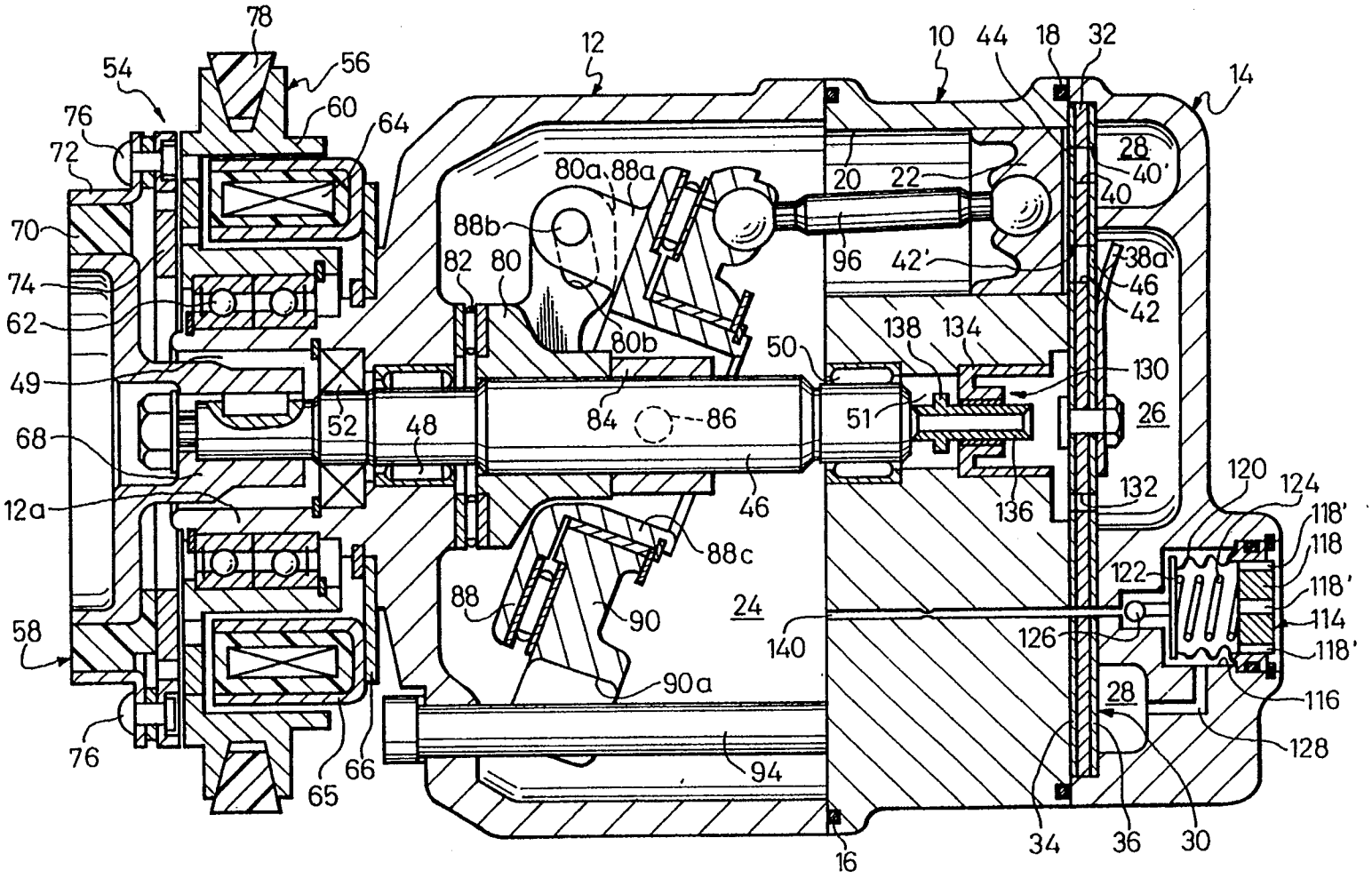
FIG. 6 is a longitudinal sectional view showing a modification of the second embodiment of FIG. 1.

FIG. 6 shows a modification of the second embodiment shown in FIGS. 4 and 5, and this modified embodiment corresponds to that of FIG. 3. In FIG. 6, the elements or features similar to those of FIGS. 3, 4 and 5 are indicated by the same references. The passage 140 is in communication with the suction chamber 28 through a valve assembly 114 similar to that shown in FIG. 3, which is provided in a bore 116 formed in the rear housing 14, and by which the pressure in the crank chamber 24 is regulated so that the displacement or capacity of the compressor is controlled in accordance with a variation of cooling load borne by the air-conditioning system. The valve assembly 114 includes a circular end plate 118, a bellows 120, a free end plate 122, a compressed coil spring 124, and a spherical valve body 126, and these elements are assembled in the same manner as in FIG. 3. The valve assembly 114 is received in the bore 116 such that the end plate 118 is securely mounted on an inner wall of the bore 116 to close an opening thereof, and such that the spherical valve body 126 is disposed in the vicinity of an end port at which the passage 140 is opened to the bore 116. An interior of the bellows 120 is in communication with the outside through ports 118' formed in the end plate 118, and the exterior of the bellows 120, and therefore the bore 116, is in communication with the suction chamber 28 through a passage 128 formed in the rear housing 14.

During the running of the compressor, communication is continuously maintained between the crank chamber 24 and the suction chamber 28 through the passage 140, but a flow rate of refrigerant introduced from the crank chamber 24 into the suction chamber 28 through the passage 140 is adjustably restricted by the spherical valve body 126 in accordance with a variation of a pressure in the suction chamber 28. In particular, as the cooing load to be borne by the air-conditioning system becomes larger, the pressure in the suction chamber 28 is increased so that the bellows 120 is compressed against the resilient force of the spring 124. Accordingly, the spherical valve body 126 is moved away from the end port of the passage 102 so as to increase the flow rate of refrigerant introduced from the crank chamber 24 into the suction chamber 28. Thus, the pressure in the crank chamber 24 approaches that of the suction chamber 28, so that the cam plate member 88 is more greatly inclined with respect to the rotational axis of the shaft 46, whereby the displacement or capacity of the compressor is increased. On the contrary, as the cooling load to be borne by the air-conditioning system becomes smaller, the pressure in the suction chamber 28 is reduced so that the bellows 120 is expanded due to the resilient force of the spring 124. Accordingly, the spherical valve body 126 is moved close to the end port of the passage 102 so as to reduce the flow rate of refrigerant introduced from the crank chamber 24 into the suction chamber 28. Thus, the pressure in the crank chamber 24 becomes relatively higher than that of the suction chamber 28, so that a degree of inclination of the cam plate member 88 becomes smaller, whereby the displacement or capacity of the compressor is reduced.

Of course, in the modified embodiment as shown in FIG. 6, when the compressor is stopped, i.e., when the rotational movement of the shaft 46 is stopped by electrically deenerging the electromagnetic clutch 54, the shaft 46 exhibit no magnetic property so that the valve body 136 is moved from the closed position (FIG. 4) toward the open position (FIG. 5), so that the communication is established between the crank chamber 24 and the discharge chamber 26. Accordingly, similar to the embodiment of FIGS. 4 and 5, the cam plate member 88 is rotated about the lateral axis defined by the pin elements 86, in the counterclockwise direction in FIG. 3, and thus, when the compressor is again run, it is not subjected to a large load at the beginning of the running thereof.

Figure 7:
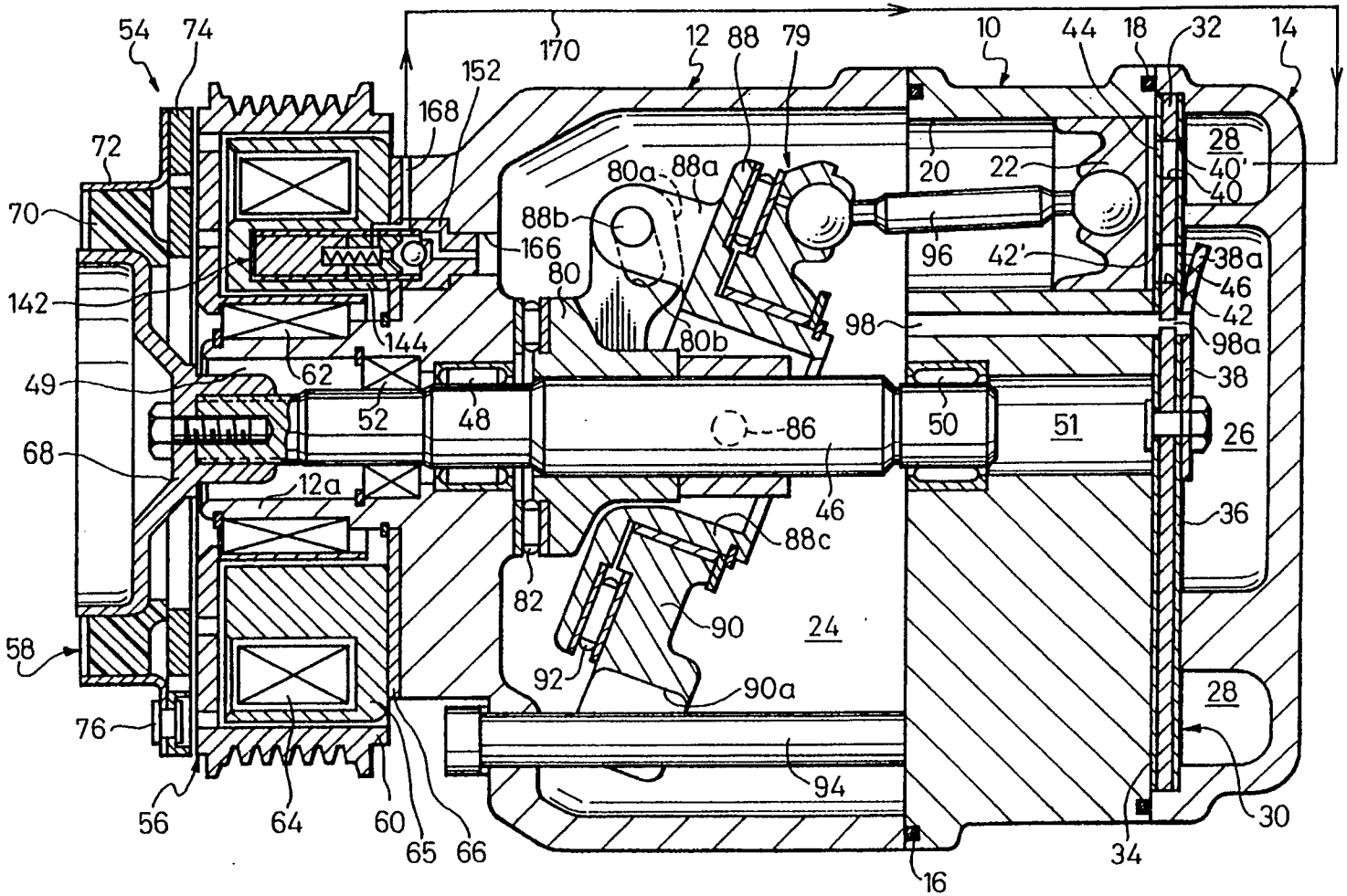
FIG. 7 is a longitudinal sectional view showing a third embodiment of a variable capacity swash-plate type compressor according to the present invention.
Figure 8:
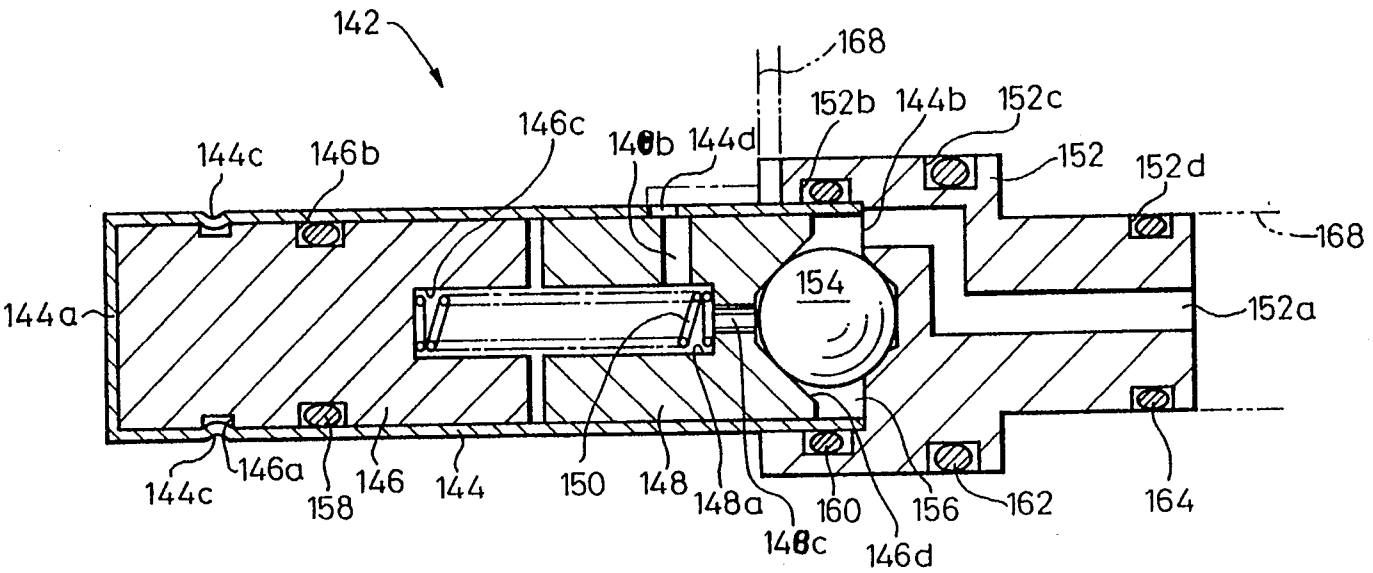
FIG. 8 is an enlarged sectional view showing a control valve assembly of the compressor of FIG. 7.

FIGS. 7 and 8 show a third embodiment of a variable capacity swash-plate compressor according to the present invention, and this embodiment is constructionally different from the first embodiment of FIGS. 1 and 2, but it is functionally similar thereto. Note, in FIGS. 7 and 8, the elements or features similar to those of the FIGS. 1 and 2 are indicated by the same references. In the third embodiment, the crank chamber 24 can be communicated with the suction chamber 28 through a control valve assembly 142 provided between the front housing 12 and the annular frame member 65 forming a part of the electromagnetic assembly 56. As shown in FIG. 8, the valve assembly 142 includes a cylindrical valve casing 144 one end of which is closed by a bottom end wall **144*a* integrally formed therewith, but the other end thereof is opened as indicated by reference 144*b* in FIG. 8. The valve assembly 142 also includes an immovable member 146 securely received in the valve casing 144 and abutted against the bottom end wall 144*a* thereof, a movable member 148 slidably and hermetically received in the valve casing 144, a compressed coil spring 150 constrained between the immovable and movable members 146 and 148, a plug member 152 for receiving the open end portion of the valve casing 144, and a spherical valve body 154 freely received in a space 156 formed between the movable member 148 and the plug member 152**.

The immovable member 146 has an annular groove **146*a* formed therearound, and some depressions 144*c* are locally formed in the valve casing 144 so as to be engaged in the annular groove 146*a*, whereby the immovable member 146 is fixed in the valve casing 144. The immovable member 146 has another annular groove 146*b* formed therearound, and an O-ring seal 158 is received in the annular groove 146*b*. The immovable member 146 has a recess 146*c* formed in an end face thereof for receiving one end portion of the spring 150, and the movable member 148 has a recess 148 formed an end face thereof for receiving the other end of the spring 150. The movable member 148*b* has a radial hole 146*b* and axial hole 148*b* formed therein, and these holes 148*b* and 148*c* are in communication with each other through the recess 148*a*. The movable member 148 has a frustum-conical recess 146*d* formed in the other end thereof, and the frustum-conical recess 146*d* forms a valve seat for the valve body 154. The valve casing 144 has a small port 144*d* formed therein, and the port 144*d* can be registered with an outside port of the radial hole 148*b*. The plug member 152 has a through passage 152*a* formed therein, and the passage 152*a* is in communication with the space 156. The plug member 152 has an inner annular groove 152*b* formed around an inner wall portion thereof, in which the open end portion of the valve housing 144 is received formed therein, and the groove 152*b* receives an O-ring seal 160 engaged with a peripheral surface of said open end portion. Further, the plug member 152 has two outer annular grooves 152*c* and 152*d* around a peripheral wall thereof for receiving two O-ring seals 162 and 164, respectively. Note, in this third embodiment, the immovable and movable members 146 and 148** are formed of a suitable magnetic material such as steel.

As is apparent from FIG. 7, the valve assembly 142 is securely and hermetically received in a bore 156 formed in the front housing 12, support plate 66, and frame member 65, and the bore 166 is opened to the crank chamber 24 at the inner wall surface of the front housing 12. A passage 168 is formed in the front housing 12, support plate 66, and frame member 65, as shown in FIG. 7, and is in communication with the suction chamber 28 through an outside fluid line 170. The passage 168 also is in communication with the radial hole **148*b* through the port 144*d* formed in the valve casing 144. The movable member 148 can be moved between a closed position, as shown in FIG. 8, in which the valve seat 146*d* is resiliently pressed against the valve body 154 and an open position, as shown in FIG. 7, in which the valve seat 146*d* is apart from the valve body 154, and in which the radial hole 148*b* is registered with the port 144*d*. Namely, when the movable member 148 is placed at the open position, the communication is established between the crank chamber 24 and the suction chamber 28, and, when the movable member 148 is placed at the closed position, the communication is cut between the crank chamber 24 and the suction chamber 28**.

When the electromagnetic clutch 54 is engaged by electrically energizing the electromagnet 64, each of the immovable and movable members 146 and 148 exhibits a magnetic property due to a magnetic field produced by the electrical energization of the electromagnet 64, so that these members are magnetically attracted to each other, whereby the movable member 148 is moved to the open position (FIG. 7) against the resilient force of the spring 150, so as to establish the communication between the crank chamber 24 and the suction chamber 28. Accordingly, similar to the first embodiment of FIGS. 1 and 2, the pressure in the crank chamber 24 is kept to be substantially equal to that in the suction chamber 28 during the running of the compressor. Thus, the cam plate member 88 is rotated about the lateral axis defined by the pin elements 68, in the clockwise direction in FIG. 7, i.e., the cam plate member 88 is inclined with the rotational axis of the shaft 46, so that a displacement or capacity of the compressor is gradually increased.

When the compressor is stopped, i.e., when the rotational movement of the shaft 46 is stopped by electrically deenerging the electromagnetic clutch 54, the immovable and movable members exhibit no magnetic property so that the movable member 148 is moved to the closed position (FIG. 8) due to the resilient force of the spring 150, whereby the communication is cut between the crank chamber 24 and the suction chamber 28. Accordingly, similar to the first embodiment of FIGS. 1 and 2, the pressure in the crank chamber 24 is immediately increased due to introduction of the pressurized refrigerant from the discharge chamber 26 into the crank chamber 24 through the restricted passage 98, so that the cam plate member 88 is rotated about the lateral axis defined by the pin elements 86, in the counterclockwise direction in FIG. 7. Namely, the cam plate member 88 is moved so that a plane thereof defines an angle of 90 degrees with respect to the rotational axis of shaft 46. Thus, when the compressor is again run, it is not subjected to a large load at the beginning of the running thereof.

Figure 9:
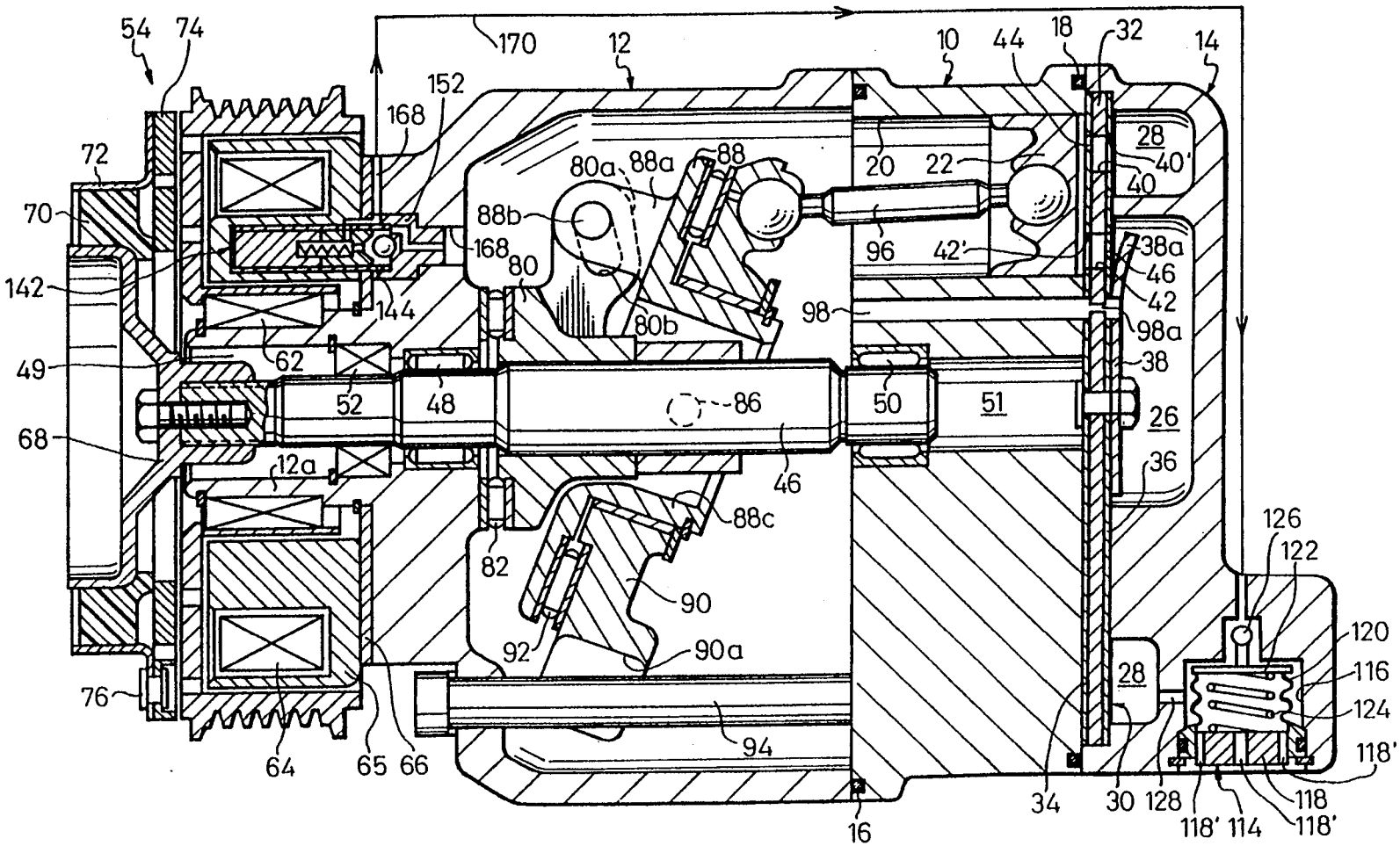
FIG. 9 is a longitudinal sectional view showing a modification of the third embodiment of FIG. 1.

FIG. 9 shows a modification of the third embodiment shown in FIGS. 7 and 8. In this modified embodiment, the outside fluid line 170 is in communication with the suction chamber 28 through a valve assembly 114 similar to that shown in FIG. 3. Accordingly, the operation is substantially identical with that of the compressor shown in FIG. 3.

Figure 10:
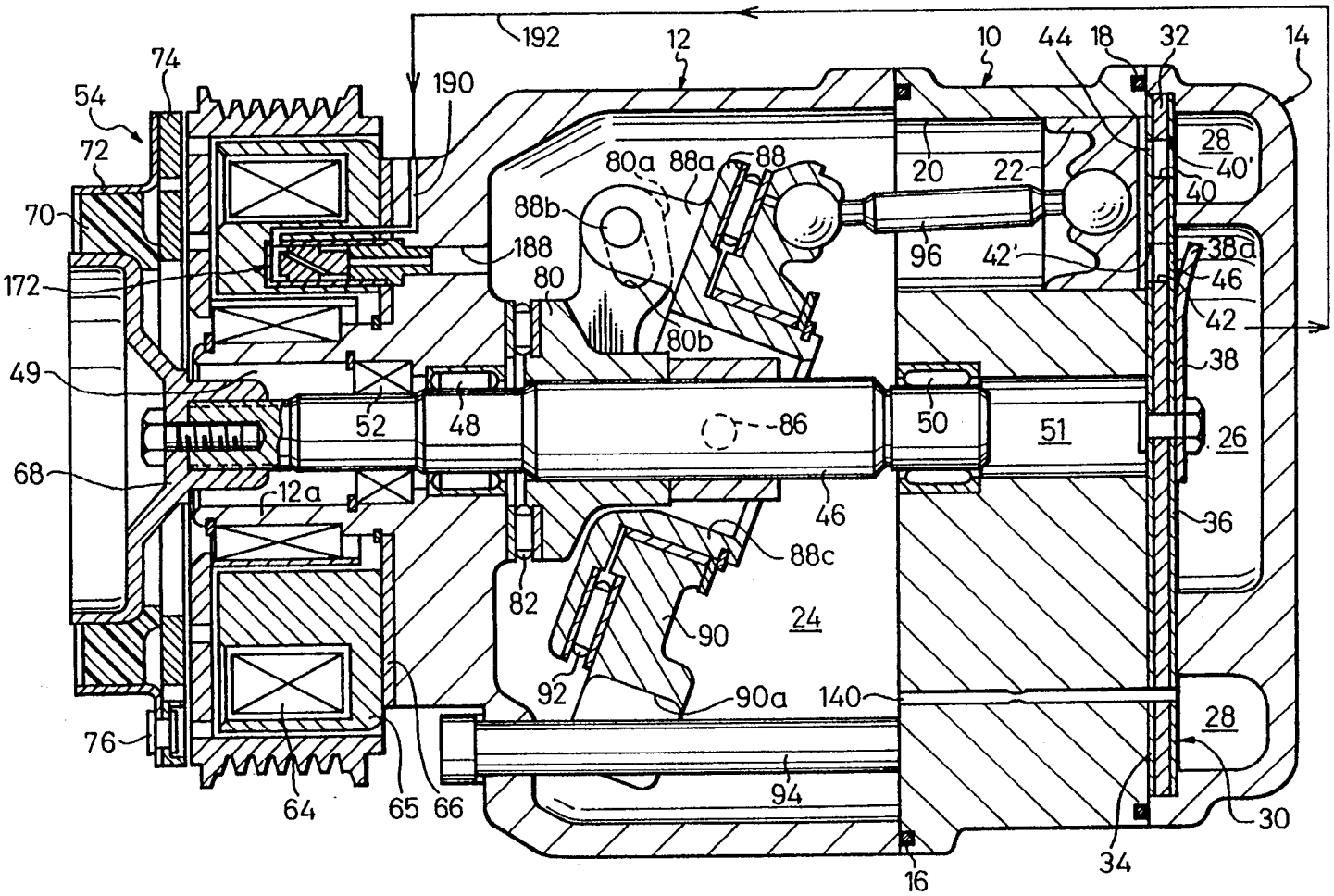
FIG. 10 is a longitudinal sectional view showing a fourth embodiment of a variable capacity swash-plate type compressor according to the present invention.
Figure 11:
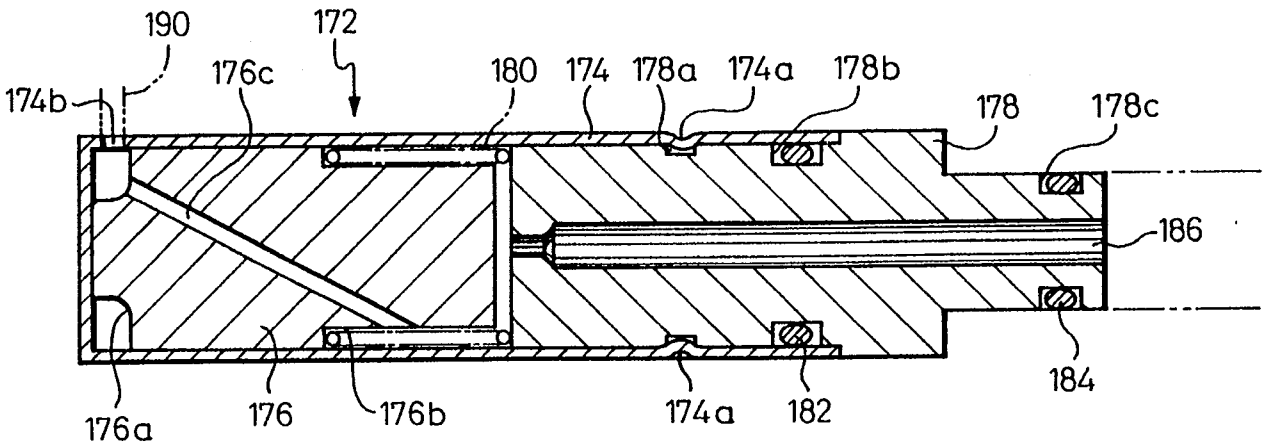
FIG. 11 is an enlarged sectional view showing a control valve assembly of the compressor of FIG. 10.

FIGS. 10 and 11 show a fourth embodiment of a variable capacity swash-plate compressor according to the present invention, and this embodiment is constructionally different from the second embodiment of FIGS. 4 and 5, but it is functionally similar thereto. Note, in FIGS. 10 and 11, the elements or features similar to those of the FIGS. 4 and 5 are indicated by the same references. In the fourth embodiment, the crank chamber 24 can communicate with the discharge chamber 26 through a control valve assembly 172 provided between the front housing 12 and the annular frame member 65 forming a part of the electromagnetic assembly 56. As shown in FIG. 11, the valve assembly 172 includes a cylindrical valve casing 174, one end of which is closed by a bottom end wall integrally formed therewith, but the other end thereof is opened. The valve assembly 172 also includes a movable member 176 slidably and hermetically received in the valve casing 174 and abutted against the bottom end thereof, an immovable member 178 securely received in the valve casing 174 so as to be partially extended outside therefrom, and a compressed coil spring 180 constrained between the movable and immovable members 176 and 178.

The movable member 176 has an annular recess **176*a* formed in one end face side thereof, and another annular recess 176*b* formed the other end face side thereof for receiving the spring 180, and the recesses 176*a* and 176*b* are in communication with each other through a sloped passage 176*c* formed in the movable member 176. An inside portion of the immovable member 178, which received in the valve casing 174, has an annular groove 178*a* formed therearound, and some depressions 174*a* are locally formed in the valve casing 174 so as to be engaged in the annular groove 178*a*, whereby the immovable member 178 is fixed in the valve casing 174. The outside portion of the immovable member 178 has another annular groove 178*b* formed around therearound, and an O-ring seal 182 is received in the annular groove 178***b*. An outside portion of the immovable member 178, which is extended outside of the valve casing 174, has an annular groove 178*c* formed therearound, and an O-ring seal 184 is received in the annular groove 178*c*. The immovable member 178 has a central passage 186 formed therein, and the passage 186 is extended between the end faces of the immovable member 178. Note, in this fourth embodiment, the movable and immovable members 176 and 178 are formed of a suitable magnetic material such as steel.

As is apparent from FIG. 10, the valve assembly 172 is securely and hermetically received in a bore 188 formed in the front housing 12, support plate 66, and frame member 65, and the bore 188 is opened to the crank chamber 24 at the inner wall surface of the front housing 12. A passage 190 is formed in the front housing 12, support plate 66, and frame member 65, as shown in FIG. 10, and is in communication with the discharge chamber 26 through an outside fluid line 192. The passage 190 also is in communication with the recess 176*a* through a port 174*b* formed in the valve casing 174. The movable member 176 can be moved between a closed position, as shown in FIG. 10, in which the movable member 176 is abutted against the immovable member 178 to close an opening end of the central passage 186 formed therein and an open position, as shown in FIG. 11, in which the movable member 176 is apart from the immovable member 178 to communicate the central passage 186 with the passage 190 through the recess 176*b*, passage 176*c*, recess 176*a*, and port 174*b*. Namely, when the movable member 176 is placed at the closed position (FIG. 10), the communication is cut between the crank chamber 24 and the discharge chamber 26, and, when the movable member 176 is placed at the open position (FIG. 11), communication is established between the crank chamber 24 and the discharge chamber 26.

When the electromagnetic clutch 54 is engaged by electrically energizing the electromagnet 64, each of the movable and immovable members 176 and 178 exhibits a magnetic property due to a magnetic field produced by the electrical energization of the electromagnet 64, so that these members are magnetically attracted to each other, whereby the movable member 176 is moved to the closed position (FIG. 10) against the resilient force of the spring 180, so that communication is cut between the crank chamber 24 and the discharge chamber 26. Accordingly, the compressor as shown in FIGS. 10 and 11 is operated in substantially the same manner as the second embodiment of FIGS. 4 and 5. Thus, the cam plate member 88 is rotated about the lateral axis defined by the pin elements 68, in the clockwise direction in FIG. 10, i.e., the cam plate member 88 is inclined with the rotational axis of the shaft 46, so that a displacement or capacity of the compressor is gradually increased.

When the compressor is stopped, i.e., when the rotational movement of the shaft 46 is stopped by electrically deenergizing the electromagnetic clutch 54, the movable and immovable members 176 and 178 exhibit no magnetic property so that the movable member 176 is moved to the open position (FIG. 11) due to the resilient force of the spring 180, whereby the communication is established between the crank chamber 24 and the discharge chamber 26. Accordingly, similar to the second embodiment of FIGS. 4 and 5, the pressure in the crank chamber 24 is immediately increased due to introduction of the pressurized refrigerant from the discharge chamber 26 into the crank chamber 24, so that the cam plate member 88 is rotated about the lateral axis defined by the pin elements 86, in the counterclockwise direction in FIG. 10. Namely, the cam plate member 88 is moved so that a plane thereof defines an angle of 90 degrees with respect to the rotational axis of shaft 46. Thus, when the compressor is again run, it is not subjected to a large load at the beginning of the running thereof.

Figure 12:
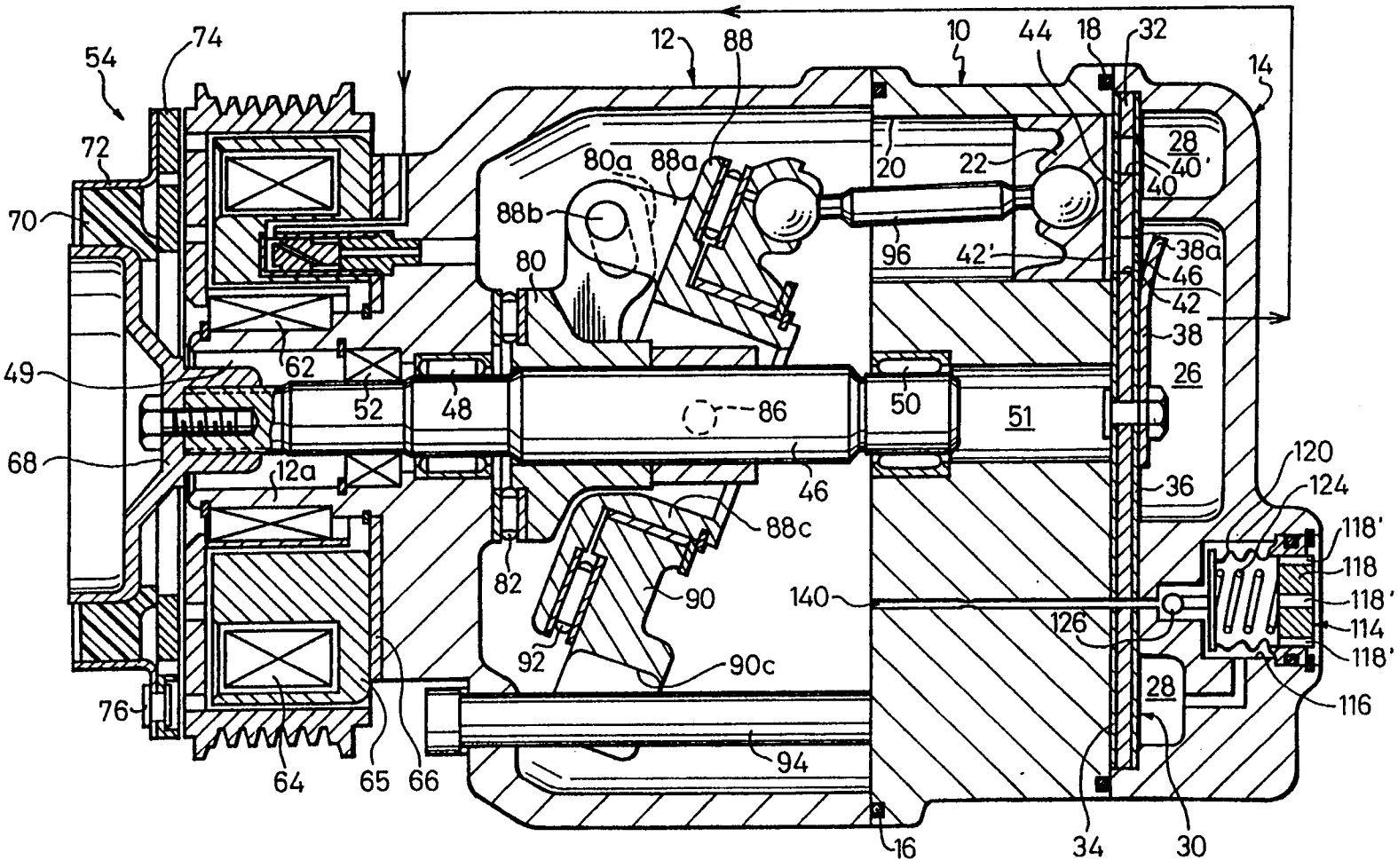
FIG. 12 is a longitudinal sectional view showing a modification of the fourth embodiment of FIG. 10.

FIG. 12 shows a modification of the fourth embodiment shown in FIGS. 10 and 11. In this modified embodiment, the outside fluid line 192 is in communication with the suction chamber 28 through a valve assembly 114 similar to that shown in FIG. 6. Accordingly, the operation is substantially identical with that of the compressor shown in FIG. 6.

As is apparent from the foregoing, according to the present invention, the control valve assembly 100, 130, 142, 172 can be actuated by utilizing the electrical energization and deenergization of the electromagnetic clutch 54, it is possible to produce a variable capacity swash-plate compressor, that does not produce an excessive load when started, at low cost.

Finally, it will be understood by those skilled in the art that the foregoing description is of preferred embodiments of the disclosed compressor, and that various changes and modifications may be made to the present invention without departing from the spirit and scope thereof.

We claim:

1. A swash-plate compressor comprising:

a cylinder block having a plurality of cylinder bores;

a plurality of pistons slidably received in the respective cylinder bores;

a first housing combined with said cylinder block to define a crank chamber;

a second housing combined with said cylinder block to define a suction chamber and a discharge chamber;

a drive shaft extended through said crank chamber;

an electromagnetic clutch means associated with said drive shaft for selectively transmitting a rotational drive force from a drive source to said drive shaft; and a conversion means for converting a rotational movement of said drive shaft into a reciprocation of each piston in the corresponding cylinder bore such that a suction stroke and a discharge stroke are alternately executed therein, a fluid being introduced into said cylinder bore during the suction stroke, and during the compression stroke, the introduced fluid being compressed in and discharged from said cylinder bore into said discharge chamber, said conversion means being constituted such that a stroke length is shortened in response to an increase of pressure in said crank chamber, and vice versa;

a first passage means for communicating said crank with said suction chamber;

a second passage means for communicating said crank chamber with said discharge chamber; and a control valve means provided in said first passage means, wherein said control valve means is magnetically actuated by electrical energization of said electromagnetic clutch means to open said first passage means, and wherein said control valve means is actuated by electrical deenergization of said electromagnetic clutch means to close said first passage means, so that the pressure in said crank chamber is increased by flow of the fluid into said crank chamber from said discharge chamber through said second passage means.

2. A swash-plate compressor as set forth in claim 1, further comprising a regulating valve means provided in said first passage means at a location between said control valve means and said suction chamber for regulating the pressure in said crank chamber in accordance with a change of the pressure in said suction chamber.

3. A swash-plate compressor as set forth in claim 1, wherein said drive shaft is formed of a magnetic material so that it exhibits a magnetic property, and said control valve means is incorporated in said cylinder block in the vicinity of one end of said drive shaft for the magnetic actuation thereof.

4. A swash-plate compressor as set forth in claim 1, wherein said control valve means is incorporated in said electromagnetic clutch means for the magnetic actuation thereof.

5. A swash-plate compressor comprising:

a cylinder block having a plurality of cylinder bores;

a plurality of pistons slidably received in the respective cylinder bores;

a first housing combined with said cylinder block to define a crank chamber;

a second housing combined with said cylinder block to define a suction chamber and a discharge chamber;

a drive shaft extended through said crank chamber;

an electromagnetic clutch means associated with said drive shaft for selectively transmitting a rotational drive force from a drive source to said drive shaft; and a conversion means for converting a rotational movement of said drive shaft into a reciprocation of each piston in the corresponding cylinder bore such that a suction stroke and a discharge stroke are alternately executed therein, a fluid being introduced into said cylinder bore during the suction stroke, and during the compression stroke, the introduced fluid being compressed in and discharged from said cylinder bore into said discharge chamber, said conversion means being constituted such that a stroke length is shortened in response to an increase of pressure in said crank chamber, and vice versa;

a first passage means for communicating said crank chamber with said suction chamber;

a second passage means for communicating said crank chamber with said discharge chamber; and a control valve means provided in said second passage means, wherein said control valve means is magnetically actuated by electrical energization of said electromagnetic clutch means to close said second passage means, and wherein said control valve means is actuated by electrical deenergization of said electromagnetic clutch means to open said second passage means, so that the pressure in said crank chamber is increased by flow of fluid between said crank chamber and said discharge chamber.

6. A swash-plate compressor as set forth in claim 5, further comprising a regulating valve means provided in said first passage means for regulating the pressure in said crank chamber in accordance with a change of the pressure in said suction chamber.

7. A swash-plate compressor as set forth in claim 5, wherein said drive shaft is formed of a magnetic material so that it exhibits a magnetic property, and vice versa, and said control valve means is incorporated in said cylinder block in the vicinity of one end of said drive shaft for the magnetic actuation of said control valve means.

8. A swash-plate compressor as set forth in claim 5, wherein said control valve means is incorporated in said electromagnetic clutch means for the magnetic actuation thereof.

* * * * *